US005465797A

United States Patent [19]

Wentworth et al.

[11] Patent Number: 5,465,797

[45] Date of Patent: Nov. 14, 1995

[54] PNEUMATIC GROUND PIERCING TOOL WITH DETACHABLE HEAD

[75] Inventors: Steven W. Wentworth, Brookfield; Jon A. Haas, Oconomowoc; Robert F. Crane, Mequon; Payce D. Reynolds, Oconomowoc, all of Wis.

[73] Assignee: Earth Tool Corporation, Oconomowoc, Wis.

[21] Appl. No.: 199,397

[22] Filed: Feb. 22, 1994

[51] Int. Cl.[6] ..... E21B 4/06; E21B 11/02

[52] U.S. Cl. ..... 173/91; 173/128; 175/19

[58] Field of Search ..... 173/90, 91, 128, 173/131; 175/19, 296

[56] References Cited

U.S. PATENT DOCUMENTS

| | | | |
|---|---|---|---|
| 3,865,200 | 2/1975 | Schmidt . | |
| 4,100,979 | 7/1978 | Schmidt | 175/19 |
| 4,100,980 | 7/1978 | Jenne | 175/19 |
| 4,221,157 | 9/1980 | Schmidt . | |
| 4,284,147 | 8/1981 | Jenne . | |
| 4,462,468 | 7/1984 | Jenne . | |
| 4,505,302 | 3/1985 | Streatfield . | |
| 4,570,723 | 2/1986 | Kostylev . | |
| 4,618,007 | 10/1986 | Kayes . | |
| 4,662,457 | 5/1987 | Bouplon | 173/91 |
| 4,809,789 | 3/1989 | McFarlane . | |
| 5,025,868 | 6/1991 | Wentworth . | |
| 5,109,932 | 5/1992 | Bueter et al. | 173/91 |
| 5,199,151 | 4/1993 | Wentworth . | |
| 5,226,487 | 7/1993 | Spektor . | |
| 5,311,950 | 5/1994 | Spektor | 175/19 |

*Primary Examiner*—Scott A. Smith
*Attorney, Agent, or Firm*—Foley & Lardner

[57] ABSTRACT

A pneumatic ground piercing tool has a head which can be removed and replaced with a replacement head of the same or different design. The detachable head is mounted on the an axial rod behind a threaded surface of the rod, and a nut is threadedly secured on the front threaded portion of the rod, whereby the head is clamped between a front end of the tool housing and the nut. The nut can be unscrewed from the rod to permit replacement of the head. A clamp-loading locking mechanism is used to secure the head to the nut to prevent the nut and head from loosening during operation.

18 Claims, 3 Drawing Sheets

PNEUMATIC GROUND PIERCING TOOL WITH DETACHABLE HEAD

TECHNICAL FIELD

This invention relates to pneumatic impact tools, particularly to self-propelled ground piercing tools.

BACKGROUND OF THE INVENTION

Self-propelled pneumatic tools for making small diameter holes through soil are well known. Such tools are used to form holes for pipes or cables beneath roadways without need for digging a trench across the roadway. These tools include, as general components, a torpedo-shaped body having a tapered nose and an open rear end, an air supply hose which enters the rear of the tool and connects it to an air compressor, a piston or striker disposed for reciprocal movement within the tool, and an air distributing mechanism for causing the striker to move rapidly back and forth. The striker impacts against the front wall (anvil) of the interior of the tool body, causing the tool to move violently forward into the soil. The friction between the outside of the tool body and the surrounding soil tends to hold the tool in place as the striker moves back for another blow, resulting in incremental forward movement through the soil. Exhaust passages are provided in the tail assembly of the tool to allow spent compressed air to escape into the atmosphere.

Most impact boring tools of this type have a valveless air distributing mechanism which utilizes a stepped air inlet. The step of the air inlet is in sliding, sealing contact with a tubular cavity in the rear of the striker. The striker has radial passages through the tubular wall surrounding this cavity, and an outer bearing surface of enlarged diameter at the rear end of the striker. This bearing surface engages the inner surface of the tool body.

Air fed into the tool enters the cavity in the striker through the air inlet, creating a constant pressure which urges the striker forward. When the striker has moved forward sufficiently far so that the radial passages clear the front end of the step, compressed air enters the space between the striker and the body ahead of the bearing surface at the rear of the striker. Since the cross-sectional area of the front of the striker is greater than the cross-sectional area of its rear cavity, the net force exerted by the compressed air now urges the striker backwards instead of forwards. This generally happens just after the striker has imparted a blow to the anvil at the front of the tool.

As the striker moves rearward, the radial holes pass back over the step and isolate the front chamber of the tool from the compressed air supply. The momentum of the striker carries it rearward until the radial holes clear the rear end of the step. At this time the pressure in the front chamber is relieved because the air therein rushes out through the radial holes and passes through exhaust passages at the rear of the tool into the atmosphere. The pressure in the rear cavity of the striker, which defines a constant pressure chamber together with the stepped air inlet, then causes the striker to move forwardly again, and the cycle is repeated.

In some prior tools, the air inlet includes a separate air inlet pipe, which is secured to the body by a radial flange having exhaust holes therethrough, and a stepped bushing connected to the air inlet pipe by a flexible hose. These tools have been made reversible by providing a threaded connection between the air inlet sleeve and the surrounding structure which holds the air inlet concentric with the tool body. The threaded connection allows the operator to rotate the air supply hose and thereby displace the stepped air inlet rearward relative to the striker. Since the stroke of the striker is determined by the position of the step, i.e., the positions at which the radial holes are uncovered, rearward displacement of the stepped air inlet causes the striker to hit against the tail nut at the rear of the tool instead of the front anvil, driving the tool rearward out of the hole.

Wentworth et al. U.S. Pat. No. 5,025,868 describes a ground-piercing tool having an improved form of screw-reverse mechanism, a unique striker having annular bearing rings at each end, and a removable, axially clamp-loaded end-cap assembly that facilitates repair and reassembly of the tool. Wentworth et al. U.S. Pat. No. 5,199,151 describes a tool of similar construction wherein the tool body is made by rotary swaging rather than by machining a solid metal bar.

Ground-piercing tools of this type have generally had a head or front anvil which is integral with the tool body. However, several designs have provided a movable head or chisel which is mounted on the front end of the tool, typically to enhance the power or striking action of the tool. See Schmidt U.S. Pat. Nos. 3,865,200 and 4,221,157, Total Quality Systems, TT Technologies, 1991, Jenne U.S. Pat. No. 4,284,147 and Spektor U.S. Pat. No. 5,226,487. In these designs the head or chisel is mounted in a manner whereby it is not readily removed without disassembling the tool more-or-less completely. Other tools have provided a separate head which is secured in a front end opening of the tool housing. See Jenne U.S. Pat. No. 4,462,468 and Kayes U.S. Pat. No. 4,618,007. These designs fail to provide a head which is readily removable because the heads must be installed very tightly to avoid breakage during use.

A variety of head designs have been proposed for pneumatic ground piercing tools in order to improve the performance of the tool or for special purposes such as pipe bursting. See, for example, Kostylev U.S. Pat. No. 4,570,723, McFarlane U.S. Pat. No. 4,809,789 and Streatfield et al. U.S. Pat. No. 4,505,302. Despite the availability of many different head types, however, no system has been proposed whereby different heads could be interchangeably mounted on the same tool for different purposes. The present invention addresses this need.

SUMMARY OF THE INVENTION

The present invention provides a pneumatic ground piercing tool having a head which can be removed and replaced with a replacement head of the same or different design. Such a tool generally includes, as essential components, an elongated tubular housing having front and rear openings, a head assembly including an anvil mechanically secured in the front opening of the housing and a detachable head mounted on the anvil, a striker disposed for reciprocation within an internal chamber of the housing to impart impacts to a rear impact surface of the anvil for driving the body through the ground, an air distributing mechanism for effecting reciprocation of the striker, and a tail assembly mounted in a rear end opening of the housing that secures the striker and air distributing mechanism in the housing.

According to a preferred form of the invention, the anvil includes a forwardly extending rod having a front circumferential threaded outer surface portion. The detachable head is mounted on the rod behind the threaded surface portion, and a nut is threadedly secured on the front threaded portion of the rod, whereby the head is clamped between a front end of the housing and the nut, and the nut can be unscrewed from the rod to permit replacement of the head. The head is preferably clamp-loaded between the nut and the housing by suitable means, such as one or more bolts. For purposes of the invention, clamp-loading refers to clamping the head under a pressure which can be gradually increased, e.g., by tightening, up to an level effective for holding the head tightly in place with great force and thereby preventing it from being damaged during tool operation.

Other objects, features and advantages of the invention will become apparent from the following detailed description. It should be understood, however, that the detailed description is given by way of illustration only, since various changes and modifications within the spirit and scope of the invention will become apparent to those skilled in the art from this detailed description.

BRIEF DESCRIPTION OF THE DRAWING

The invention will hereafter be described with reference to the accompanying drawing, wherein like numerals denote like elements, and.

DETAILED DESCRIPTION OF PREFERRED EMBODIMENTS

Figure 1:
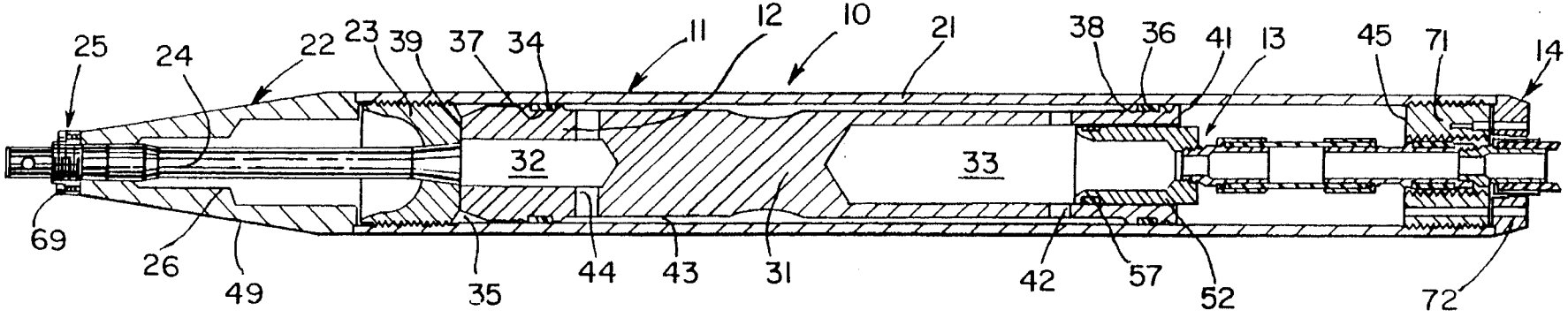
FIG. 1 is a lengthwise sectional view of an impact tool according to the invention.

Referring now to FIGS. 1 to 8, a pneumatic ground piercing tool 10 according to the invention includes, as main components, a tool body 11 which includes a housing 21 and head assembly 22, a striker 12 for impacting against the interior of body 11 to drive the tool forward, a stepped air inlet conduit 13 which cooperates with striker 12 for forming an air distributing mechanism for supplying compressed air to reciprocate striker 12, and a tail assembly 14 which allows exhaust air to escape from the tool, secures conduit 13 to body 11, and provides a threaded connection to allow reverse operation. Stepped air inlet conduit 13 includes a flexible hose 51, a tubular bushing 52 threadedly coupled with a rearwardly extending fitting 50, and a forward-reverse adjuster screw mechanism 54. Tail assembly 14 includes a tail nut (rear anvil) 71 and an end cap (cone) 72 secured together by bolts 73. Nut 71 is threadedly secured in a rear opening of the tool body 11 and has exhaust passages 79 therein. Except as described below, the foregoing components function generally in the same manner as described in Wentworth et al. U.S. Pat. No. 5,025,868, issued Jun. 25, 1991, the entire contents of which are incorporated by reference herein.

Striker 12 is disposed for sliding, back-and-forth movement inside of tool body 11 forwardly of conduit 13 and tail assembly 14. Striker 12 comprises a generally cylindrical rod 31 having frontwardly and rearwardly opening blind holes (recesses) 32, 33 respectively therein. Pairs of plastic, front and rear seal bearing rings 34, 36 are disposed in corresponding annular grooves 37, 38 in the outer periphery of rod 31 for supporting striker 12 for movement along the inner surface of housing 21. Annular front impact surface 39 impacts against anvil 23 when the tool is in forward mode, and an annular rear impact surface 41 impacts against front end 45 of tail assembly 14 when the tool is in rearward mode.

A plurality of rear radial holes 42 allow communication between recess 33 and an annular space 43 between striker 12 and housing 21 bounded by seal rings 34, 36. A second set of front radial holes 44 allow communication between space 43 and front recess 32. Annular space 43, holes 44, front recess 32 and the interior space of body 11 ahead of rings 34 together comprise the front, variable-volume pressure chamber 35 of the tool.

Figure 2:
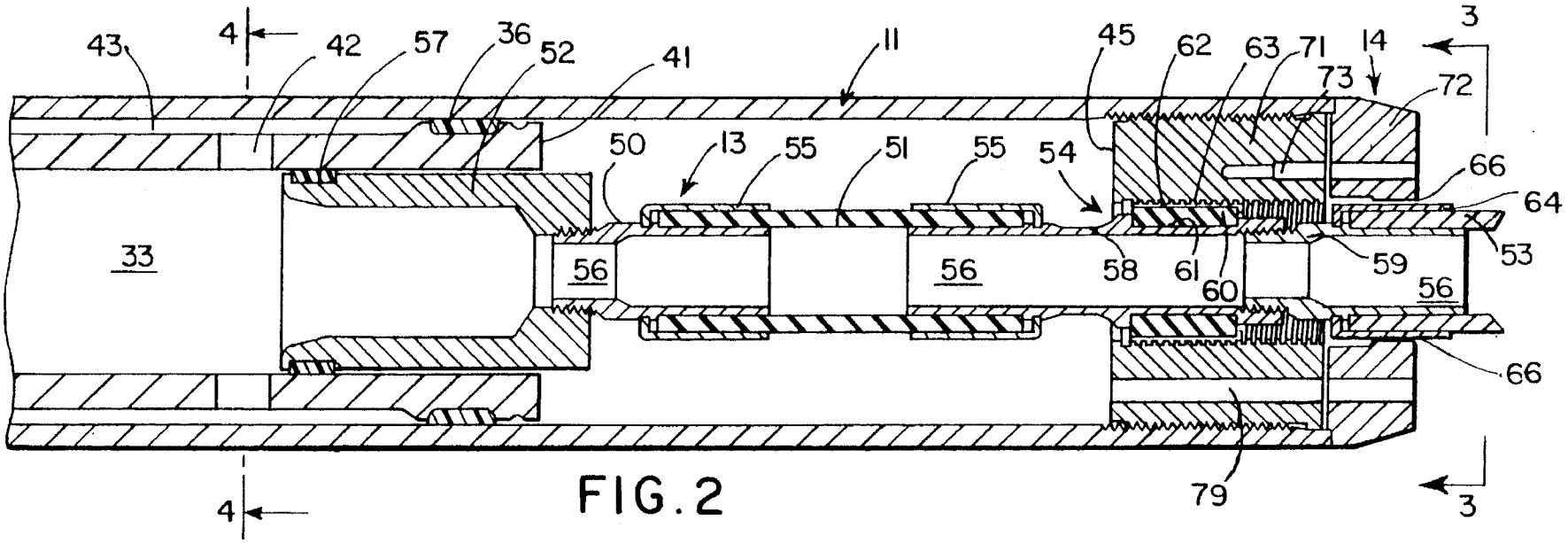
FIG. 2 is an enlarged sectional view of the rear end of the tool shown in FIG. 1.
Figure 3:
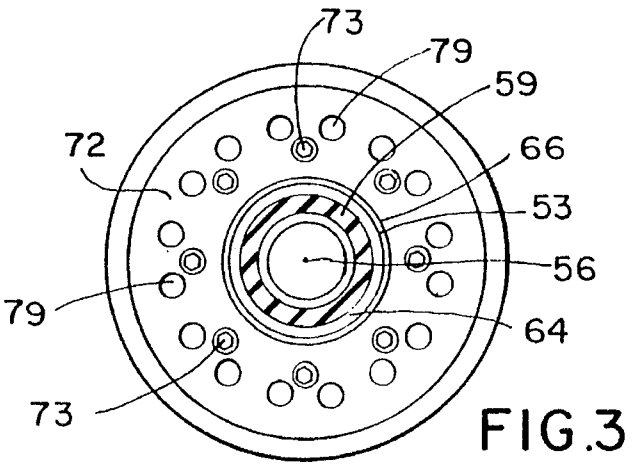
FIG. 3 is a rear view, with the air hose in section, of the tool shown in FIG. 2.
Figure 4:
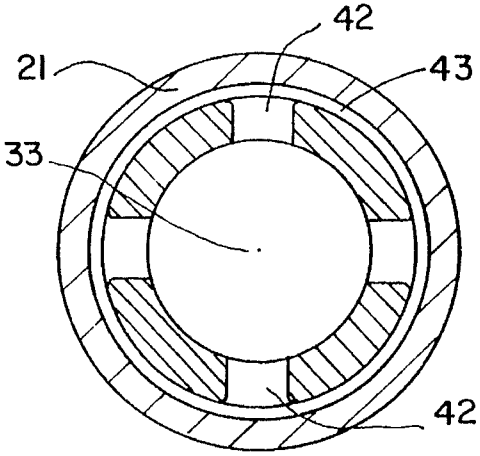
FIG. 4 is a cross-sectional view taken along the line 4—4 in FIG. 2.
Figure 5:
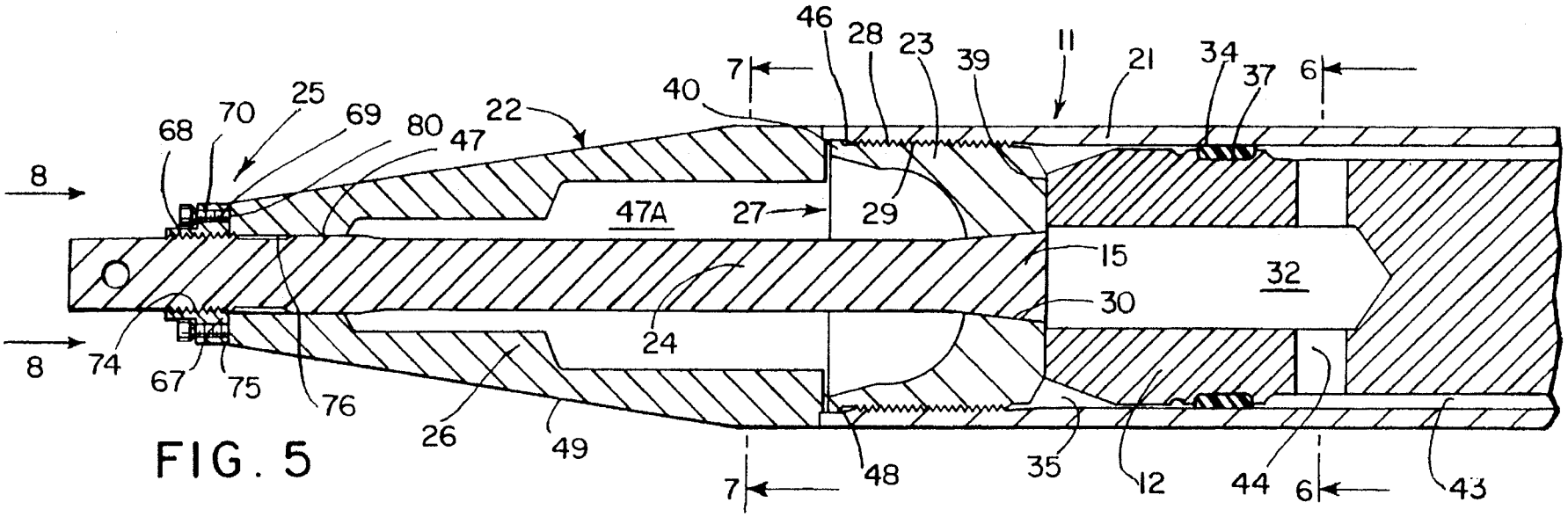
FIG. 5 is an enlarged sectional view of the front end of the tool shown in FIG. 1.
Figure 6:
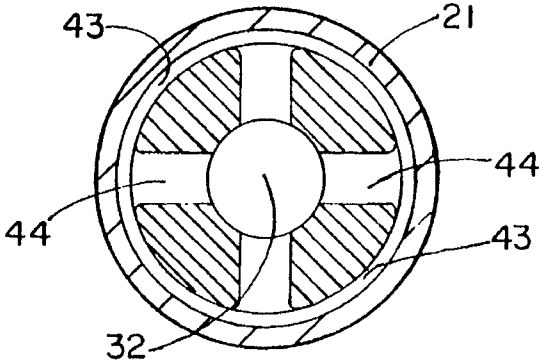
FIG. 6 is a cross-sectional view taken along the line 6—6 in FIG. 5.
Figure 7:
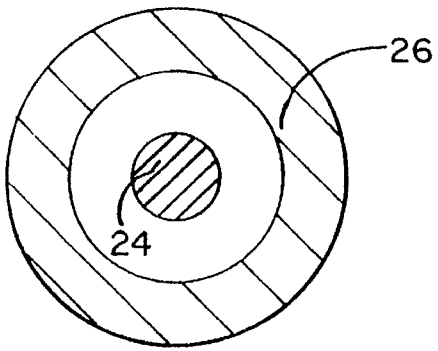
FIG. 7 is a cross-sectional view taken along the line 7—7 in FIG. 5.
Figure 8:
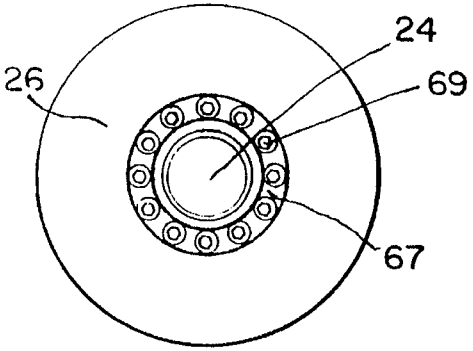
FIG. 8 is a front view of the tool shown in FIG. 5.

Referring to FIGS. 2, 3 and 4, stepped air inlet conduit 13 includes a flexible hose 51, a tubular bushing 52, and an adjuster screw mechanism 54. Hose 51, which may be made of rubberized fabric, is secured by a coupling 55 to a front end portion of adjuster screw mechanism 54, which is in turn coupled to a further length of hose 53 which ultimately connects tool 10 with the air compressor. An axial bore 56 which extends through adjuster screw mechanism 54, hose 51, and bushing 52 allows compressed air to pass from hose 53 through cavity 33.

The cylindrical outer surface of bushing 52 is inserted into cavity 33 in slidable, sealing engagement with the wall thereof. Cavity 33 and the adjoining interior space of stepped conduit 13 together comprise a rear, constant pressure chamber which communicates intermittently with the front, variable pressure chamber by means of holes 42. Bushing 52 may, if needed, have a plastic bearing ring 57 disposed in an annular peripheral groove to reduce air leakage between bushing 52 and the wall of cavity 33. Bushing 52 is preferably made of a light-weight material such as plastic.

Adjuster screw mechanism 54 includes front and rear sleeve sections 58, 59 which are threadedly coupled end-to-end as shown. This two-part construction facilitates assembly and disassembly of mechanism 54. An elastomeric shear coupling 60 is disposed in an annular groove 61 in the outer surface of front sleeve section 58 towards its rear end. An outer sleeve 62 is mounted on the outer periphery of shear coupling 60, which is preferably adhesively bonded to both sleeve 62 and groove 61. Outer sleeve 62 has external peripheral threads 63 for securing the stepped conduit 13 to tail assembly 14, as described further below. Outer sleeve 62 is made as short as possible, e.g., only about half or less the length of the threaded hole in which it is mounted. Sleeve 62 preferably is only long enough to provide enough screw thread turns to effect the operating mode change, such as about 6 or less. The rear end of rear section 59 of adjuster screw 54 has hose 53 secured thereto by a coupling 64 which extends together with hose 53 through a central hole 66 in end cap 72.

Referring to FIGS. 5, 6, 7 and 8, tool body 11 comprises a cylindrical tubular housing 21 having a tapered head assembly 22 which embodies the detachable head according to the invention. Head assembly 22 includes an anvil 23 mechanically secured in a front opening 27 of the body, by, for example, external threads 28 engaged with internal threads 29 formed on the inner periphery of housing 21 near the front opening. Anvil 23 has a forwardly extending central rod 24 which extends in the axial direction of the tool. Anvil 23 preferably comprises a steel cylinder having a central hole 30. Rod 24 has a rear end portion 15 which is retained in central hole 30 of anvil 23. Central hole 30 tapers frontwardly, and rear end portion 15 of rod 24 has a frontwardly tapering outer surface that fits closely within central hole 30. Anvil 23 further has a front, outwardly extending annular flange 40 which engages a step 46 formed on the inner periphery of front end opening 27 of housing 21. Flange 40 engages step 46 and thereby acts as a stop to retain the anvil against excessive rearward movement.

A detachable head 26 is mounted on rod 24 by means of a central opening 47 through which rod 24 extends. Central opening 47 is slightly larger in diameter than rod 24 at a front end of central opening 47 to facilitate sliding movement of the detachable head along rod 24. An inner boss 48 at the rear end of head 26 spaced slightly inwardly from the outer periphery of head 26 fits inside front end opening 27 of housing 21 to help secure head 26 against housing 21 in the proper position. Central opening 47 of head 26 has a rear portion of larger diameter than the front end portion thereof that forms a cavity 47A about the rod, thereby decreasing the weight of head assembly 22.

Detachable head 26 has a frontwardly tapering outer surface 49 that gives the head a generally frustoconical shape comparable to that of the nose portion of conventional pneumatic ground piercing tool bodies, but may have a variety of shapes, e.g., may be cylindrical, and may be provided with annular or lengthwise fins or cutters for movement through difficult soils or for special tasks such as pipe bursting. For fin designs, see Kostylev U.S. Pat. No. 4,570,723 and McFarlane U.S. Pat. No. 4,809,789, the contents of which are hereby incorporated by reference herein. For pipe bursting cutters, see, for example, Streatfield et al. U.S. Pat. No. 4,505,302, the contents of which are hereby incorporated by reference herein. The blade arrangement of Streatfield '302 FIGS. 1–3 may be used on a head 26 according to the invention without the blade actuating mechanism described in Streatfield et al.

A releasable locking mechanism 25 secures head 26 over the front opening 27 of housing 21. Releasable locking mechanism 25 includes a ring nut 67 threadedly secured on a front circumferential threaded outer surface portion 68 of rod 24 disposed in front of head 26, whereby head 26 is clamped between housing 21 and nut 67. Mechanism 25 further comprises suitable means for clamp-loading head 26 to the nut 67, such as one or more threaded bolts 69 inserted through threaded holes 70 in nut 67. Holes 70 extend in parallel to the lengthwise axis of the tool and are preferably arranged in a symmetrical formation around the center hole 74 of nut 67.

Ends 80 of bolts 69 engage an annular front surface 75 of detachable head 26, pressing head 26 against housing 21 and thereby stretching rod 24 to provide the clamp-loading effect. For this purpose, rod 24 preferably has a shallow annular undercut 76 near and to the rear of threaded portion 68. Undercut 76 accommodates distortion of rod 24 during stretching and thereby improves the durability of the tool. For a similar reason, the intermediate portion of rod 24 within cavity 47A has a slightly reduced diameter.

Detachable head 26 remains securely in place notwithstanding the powerful impacts delivered by striker 12 to the front end of the tool. If head 26 were not tightly secured with the aid of the clamp-loading locking mechanism 25, it would quickly be destroyed in use. For this purpose, the nose bolts 69 are preferably tightened to exert at least about 100,000 pounds of tensile force on rod 24.

Figure 9:
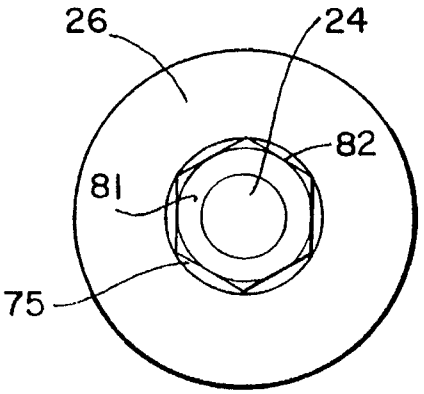
FIG. 9 is a front view of an alternative embodiment of the invention.

According to an alternative form of the invention shown in FIG. 9, ring nut 67 is replaced by a hex nut 81 having flats 82. Bolts 69 are omitted. To provide the needed clamp-loading on head 26, hex nut 81 must be tightened by means of flats 82 with great force. This embodiment has the advantage of needing fewer parts, but nut 81 can be difficult to remove because of the tightness with which it is secured.

Apart from providing a system for interchanging or replacing the head of the tool, the present invention also eliminates the need to use a swaged or machined tool body having a tapered front nose section. Housing 21 can instead be a cylindrical steel pipe, reducing the cost of tool manufacture.

It will be understood that the foregoing description is of preferred exemplary embodiments of the invention, and that the invention is not limited to the specific forms shown. For example, anvil 23 and rod 24 may be integrally formed as a single piece. Anvil 23 may be retained in the front opening of the tool body by a locking-taper arrangement similar to that shown for the rod and anvil assembly, or by a retaining flange or ring on the front opening of the body. These and other modifications may be made in without departing from the scope of the invention as expressed in the appended claims.

We claim:

1. A pneumatic ground piercing tool, comprising:

an elongated tubular housing having front and rear openings;

a head assembly including an anvil mechanically secured in the front opening of the housing and having a forwardly extending central rod, a detachable head mounted on the rod, the head having a central opening through which the rod extends, and a releasable locking mechanism that clamps the detachable head between the releasable locking mechanism and the housing and secures the head over the front opening of the housing;

a striker disposed for reciprocation within an internal chamber of the housing to impart impacts to a rear impact surface of the anvil for driving the tool through the ground;

an air distributing mechanism for effecting reciprocation of the striker; and a tail assembly mounted in a rear end opening of the housing that secures the striker and air distributing mechanism in the housing.

2. The tool of claim 1, wherein the releasable locking mechanism comprises a nut threadedly secured on a front circumferential threaded outer surface portion of the rod disposed in front of the head, whereby the head is clamped between the housing and the nut.

3. The tool of claim 2, wherein the releasable locking mechanism further comprises means for clamp-loading the head between the nut and the housing.

4. The tool of claim 3, wherein the clamp-loading means comprises one or more bolts mounted in and extending through threaded holes in the nut, which holes extend in the lengthwise direction of the tool, the bolts having ends which engage a front surface of the detachable head.

5. The tool of claim 4, wherein the anvil has external threads engaged with internal threads formed on the inner periphery of the housing near the front opening thereof.

6. The tool of claim 5, wherein the anvil comprises a cylinder having a central hole, and the rod has an enlarged rear end portion which is retained in the central hole of the anvil.

7. The tool of claim 6, wherein the central hole in the anvil tapers frontwardly, and the rear end portion of the rod has a frontwardly tapering outer surface that fits closely within the central hole.

8. The tool of claim 7, wherein the anvil has a front, outwardly extending annular flange which engages a step formed on the inner periphery of the housing and is effective to retain the anvil against rearward movement.

9. The tool of claim 4, wherein the detachable head has a central opening slightly larger in diameter than the rod at a front end of the central opening to facilitate sliding movement of the detachable head along the rod, and a boss at a rear end of the head which fits inside the front end opening of the housing.

10. The tool of claim 9, wherein the detachable head has a frontwardly tapering outer surface that gives the head a generally frustoconical shape.

11. The tool of claim 10, wherein the central opening of the detachable head has a rear portion of larger diameter than the front end portion thereof that forms a cavity about the rod.

12. The tool of claim 1, wherein the anvil has external threads engaged with internal threads formed on the inner periphery of the housing near the front opening thereof.

13. The tool of claim 1, wherein the anvil comprises a cylinder having a central hole, and the rod has an enlarged rear end portion which is retained in the central hole of the anvil.

14. The tool of claim 13, wherein the central hole in the anvil tapers frontwardly, and the rear end portion of the rod has a frontwardly tapering outer surface that fits closely within the central hole.

15. The tool of claim 1, wherein the anvil has a front, outwardly extending annular flange which engages a step formed on the inner periphery of the housing and effective to retain the anvil against rearward movement.

16. The tool of claim 1, wherein the striker has a rearwardly opening recess and a rear radial passage through a wall enclosing the recess, a front end portion having a bearing thereon for sliding engagement with the internal chamber and passages permitting flow of pressure fluid to a front, variable-volume pressure chamber ahead of the striker, and a rear end portion having a bearing thereon rearwardly of the radial passage for sliding engagement with the internal chamber; and the air distribution mechanism includes a stepped air inlet conduit which cooperates with the striker within the internal chamber of the housing to impart blows to a rear impact surface of the anvil under the action of a pressure fluid fed into the rear opening in the striker, followed by reverse movement of the striker upon passage of the rear radial passage past a front edge of the step of the stepped air inlet conduit, and exhaust of compressed air upon passage of the rear radial passage past a rear edge of the step of the stepped air inlet conduit.

17. A pneumatic ground piercing tool, comprising:

an elongated tubular housing having front and rear openings;

a head assembly including:

an anvil mechanically secured in the front opening of the housing and having a forwardly extending rod having a front circumferential threaded outer surface portion, a detachable head slidably mounted on the rod behind the threaded surface portion, a nut threadedly secured on the front threaded portion of the rod, whereby the head is clamped between a front end of the housing and the nut, and means for clamp-loading the head between the nut and the housing;

a striker disposed for reciprocation within an internal chamber of the housing to impart impacts to a rear impact surface of the anvil for driving the tool through the ground, the striker having a rearwardly opening recess and a rear radial passage through a wall enclosing the recess, a front end portion having a bearing thereon for sliding engagement with the internal chamber and passages permitting flow of pressure fluid to a front, variable-volume pressure chamber ahead of the striker, and a rear end portion having a bearing thereon rearwardly of the radial passage for sliding engagement with the internal chamber;

a stepped air inlet conduit which cooperates with the striker within the internal chamber of the housing to impart blows to the impact surface of the anvil under the action of a pressure fluid fed into the rearwardly opening recess in the striker, followed by reverse movement of the striker upon passage of the rear radial passage past a front edge of a step of the stepped air inlet conduit, and exhaust of compressed air upon passage of the rear radial passage past a rear edge of the step of the stepped air inlet conduit; and a tail assembly mounted in the rear end opening of the housing for securing the striker and air inlet conduit in the body.

18. The tool of claim 1, wherein the rod extends completely through the central opening in the detachable head so that a front end portion of the rod protrudes from the detachable head, and the releasable locking mechanism is mounted in front of the detachable head on the front end portion of the rod.

* * * * *